United States Patent [19]

Gutknecht

[11] Patent Number: 4,979,881

[45] Date of Patent: Dec. 25, 1990

[54] TURBOCHARGER WITH WATER COOLED CENTER HOUSING

[75] Inventor: Daniel A. Gutknecht, Torrance, Calif.

[73] Assignee: Allied-Signal Inc., Morristown, N.J.

[21] Appl. No.: 404,383

[22] Filed: Sep. 8, 1989

[51] Int. Cl.[5] ..... F04B 17/00

[52] U.S. Cl. ..... 417/407

[58] Field of Search ..... 417/405, 406, 407; 60/605

[56] References Cited

U.S. PATENT DOCUMENTS

| | | | |
|---|---|---|---|
| Re. 30,333 | 7/1980 | Gordon, Jr. et al. | 417/407 |
| 2,159,422 | 5/1939 | Buchi | 417/407 |
| 2,582,916 | 1/1952 | Taub . | |
| 4,107,927 | 8/1978 | Gordon, Jr. et al. | 60/605 |
| 4,147,467 | 4/1979 | Leicht et al. | 60/605 |
| 4,704,075 | 11/1987 | Johnston et al. | 417/407 |

FOREIGN PATENT DOCUMENTS

| | | | |
|---|---|---|---|
| 35-1602 | 1/1960 | Japan . | |
| 178828 | 10/1983 | Japan | 417/407 |
| 178522 | 8/1986 | Japan | 417/407 |

OTHER PUBLICATIONS

*Diesel Engine Catalog*, vol. 20 (1955–1956), p. 274.

*Primary Examiner*—Louis J. Casaregola
*Assistant Examiner*—Timothy S. Thorpe
*Attorney, Agent, or Firm*—Ken C. Decker; William N. Antonis

[57] ABSTRACT

An exhaust gas driven turbocharger includes a center housing comprising a circumferentially extending annular wall enclosing a cavity in which the bearings supporting the turbocharger shaft are mounted. The center housing also includes a separate hollow annular member, which extends circumferentially around the shaft and extends radially from the circumferentially extending wall to the shaft. A cavity is defined within the hollow annular member, which receives coolant from the vehicle coolant system, to thereby control heat transfer from the turbine to the center housing and the bearings contained therewithin.

10 Claims, 1 Drawing Sheet

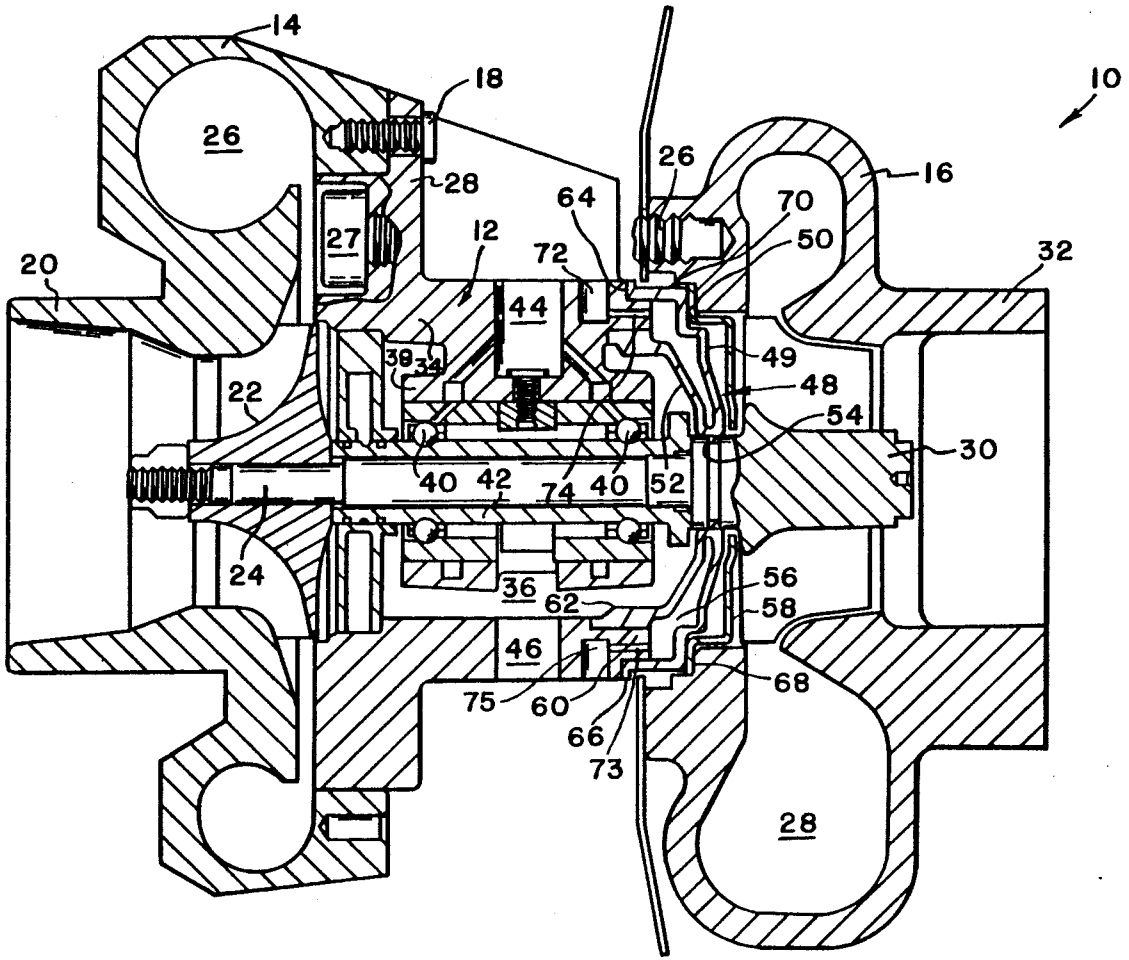
10
32
16
70
50
26
64
72
18
28
14
26
20
30
49
48
54
52
40
74
42
40
12
44
39
34
27
22
24
36
62
46
75
60
66
73
56
58
68
28

TURBOCHARGER WITH WATER COOLED CENTER HOUSING

This invention relates to a turbocharger having a water cooled center housing.

In order to prevent coking, or oxidation of oil due to the high temperature, on the wall and bearings adjacent the turbine housing of an exhaust gas driven turbocharger, it has become necessary to cool the center housing by communicating engine coolant through a water jacket cast into the wall of the turbocharger center housing. A typical prior art design is disclosed in U.S. Reissue Pat. No. 30,333. This prior art water cooled center housing is manufactured from cast iron in which sand cores are used to form the water jacket. The water jackets in these turbochargers are difficult to cast, are subject to leaking due to casting porosity, and it is quite difficult to clean the core sand out of the water jacket during manufacture. Another turbocharger housing water jacket design is disclosed in U.S. Pat. No. 4,704,075.

The present invention provides a coolant cavity formed in a separate annular part which mates with the rest of the center housing. The annular part or member may be made by conventional casting processes in which cores are used, but the main portion of the center housing may be die cast, with resulting reduction in component cost and assembly cost. The annular member serves as the turbine back plate, and is much easier to manufacture than conventional sand core cast center housings due to the simplified design of the water cavity. Furthermore, the annular member can extend around the housing for 360°, thereby assuring efficient cooling of the housing. Since the annular member is a relatively small sand casting, water leakage due to casting porosity is eliminated.

These and other advantages of the present invention will become apparent from the following description, with reference to the accompanying drawing, the sole FIGURE of which is a cross-sectional view of a turbocharger made pursuant to the teachings of the present invention.

Referring now to the drawing, a turbocharger, generally indicated by the numeral 10 includes a center housing 12, a compressor housing 14, and a turbine housing 16. Compressor housing 14 is secured to center housing 12 by screws 18. Compressor housing 14 includes an inlet 20 which communicates air to a conventional compressor wheel 22 which is mounted for rotation with a shaft 24. Housing 14 further includes a conventional volute 26 which communicates compressed air from the discharge of the compressor wheel 22 to the air outlet (not shown).

The turbine housing 16 is secured to the end of the center housing 12 opposite the end to which the compressor housing 14 is installed. Bolts 26 extend through flange 28 on the center housing 12 adjacent the compressor housing 14 and extend across the center housing 12 to threadly engage the turbine housing 16. Turbine housing 16 includes an inlet volute 28, which communicates exhaust gases to conventional turbine wheel 30, which is mounted for rotation with the shaft 24. An outlet duct 32 communicates the discharge side of the turbine wheel 30 with the vehicle exhaust system.

Center housing 12 is defined by circumferentially extending wall 34 which defines a cavity 36 therewithin. A bearing carrier 38 is supported in the cavity 34. Axially spaced roller bearings 40 are supported in the carrier 38 for rotationally supporting shaft 24 which extends through a sleeve 42, which extends through the cavity 36 and rotates with shaft 24. It will be noted, of course, that the ends of the shaft 24 project into the compressor housing 14 and turbine housing 16 respectively, and the compressor wheel 22 and turbine wheel 30 are mounted on the ends of the shaft 24 that extend into the housings 14 and 16. An oil inlet 44 supplies lubricating oil to the bearings 40, and an oil drain 46 drains oil from the bearings 40.

Center housing 12 further includes a hollow annular member generally indicated by the numeral 48. Hollow annular member 48 may conveniently be made from a different material and by a different process than is the remainder of the center housing 12, including the circumferentially extending wall 34. For example, the portion of the center housing 12 comprising the circumferentially extending wall 34 and the bearing carrier 38 may be made from a die casting processing, whereas the hollow annular member 48 may be made from a conventional sand core casting method. The hollow annular member 48 extends radially inwardly from the circumferentially extending wall 34 to the shaft 24, thereby closing the end of the cavity 36 between the center housing, 12 and the turbine housing 16.

The hollow annular member 48 consists of pair of circumferentially extending, converging walls 49, 52. The walls converge as they project radially inwardly toward the shaft 24, and terminate in a circumferentially extending surface 54 which circumscribes the shaft 24. The walls 49, 52 cooperate to define a circumferentially extending coolant receiving cavity 56 therebetween. The cavity 56 preferably extends completely around the shaft 24, and, as discussed hereinabove, closes the end of the cavity 36.

The coolant in the cavity 56 acts as a thermal barrier between the extremely hot turbine section of the turbocharger 10 enclosed within the turbine housing 16 and the bearing 40 adjacent the turbine housing 16. Accordingly, during operation of the turbocharger, the transfer of heat from the relatively hot turbine housing 16, which is heated by the extremely hot exhaust gases passing through the turbine wheel 30, to the bearing 40 adjacent the turbine wheel 30 will be inhibited so that the temperature of the bearings 40 adjacent the turbine wheel 30 will be substantially less due to the presence of the coolant in the hollow annular cavity 56. Accordingly, the temperature of bearing 40 may be kept below the temperature in which oil used to lubricate the bearings 40 carbonizes, which is detrimental to bearing performance. A conventional shroud. 58 is placed between the turbine housing 16 and the hollow annular member 48.

The wall 34 of center housing 12 includes an axially projecting, circumferentially extending portion 60 which is received within a correspondingly shaped section 62 of the cavity 56. Projecting portion 60 cooperates with the remainder of the wall 34 to define a circumferentially extending surface 64 to which engages flange 66 of wall 70. A shoulder 68 on turbine housing 16 restrains portion 50 of the wall 70, which extends between the shoulder 66 and the, shoulder 68 on the turbine housing 16. Accordingly, the hollow annular member 48 is retained on the assembly between the center lousing 12 and the turbine housing 16 by clamping forces acting through the shoulder 68 of the turbine housing 16, transmitted through portion 70 of the wall 50, and the shoulder 66 on the wall 34. These clamping forces are generated by tightening bolts 26, which secures the turbine housing 16 to the center housing 12. Coolant is communicated into the cavity 56 through an inlet connection 72 and passage way 74 extending through axially projecting portion 60 of the wall 34. Connection 72 is communicated to the vehicle coolant system. A similar passage 73 and connection 75 are spaced circumferentially around the wall 34 from the connection 72 and passage 74, to provide a drain passage for draining coolant fluid from the annular chamber 56.

In operation, exhaust gases communicated through turbine inlet volute 28 through the turbine wheel 30 cause rotation of the latter, thereby rotating the shaft 24 causing rotation of compressor wheel 22, which compresses air drawn through inlet connection 20. Compressed air generated by rotation of the compressor wheel 22 is communicated through outlet volute 26 and then to the inlet manifold of the vehicle. Because of the temperature of the exhaust gases, the turbine housing 16 quickly attains a relatively high temperature. Unless heat transfer to the bearing 40 closest to the turbine housing 16 is controlled, the temperature of the bearing 40 can attain temperatures sufficient to cause the oil communicated through the bearings through passages 44 and 46 to carbonize during heat soak conditions after engine shutdown when cooling by lubricating oil pumped through the bearings 40 during normal engine operation is no longer available, thereby substantially reducing bearing life. However, as discussed above, coolant in chamber 56 acts as a barrier for heat transfer to the bearing 40, since the heat of the turbine housing 16 is transferred to the, coolant in cavity 56, which is circulated through the hollow annular member 48. Hollow annular member 48 preferably extends completely around the shaft 24 so that the protection of the bearing 40 adjacent the turbine housing 16 is more effective than prior art devices, in which the coolant cavity extends only part of the way around the shaft 24. Use of hollow annular member 48 permits the coolant in the cavity 56 to extend to wall 54, thereby maintaining wall 52 at substantially reduced temperatures and preventing oxidation or coking of oil in proximity of shaft 24. Cavity 56 cannot be formed in prior art devices due to the need for small discrete passageways 74 and 72 as the internal cores forming cavity 56 cannot be effectively removed after casting.

What is claimed is:

1. A turbocharger comprising a center housing, a compressor housing, and a turbine housing, means for securing the compressor housing and the turbine housing to the center housing, said center housing having a circumferentially extending outer wall defining a cavity within the center housing, means carried by the center housing for rotatably supporting a shaft within said cavity, said shaft including portions extending into said turbine housing and into the compressor housing, a turbine wheel mounted on the portion of the shaft within the turbine housing, a compressor wheel mounted on the portion of the shaft within the compressor housing, and a hollow annular member closing the end of said cavity traversed by the portion of the shaft extending into the turbine housing, said hollow annular member defining a circumferentially extending cavity therewithin, and means for communicating a liquid coolant into and out of said cavity.

2. Turbocharger as claimed in claim 1, wherein said hollow annular member circumscribes at least a portion of the shaft and extends radially inwardly from said wall to said shaft to define a radially extending closure between the center housing and the turbine housing.

3. Turbocharger as claimed in claim 2, wherein said hollow annular member is clamped between the center housing and the turbine housing.

4. Turbocharger as claimed in claim 2, wherein one of said center housing and said turbine housing includes a circumferentially extending, axially projecting portion and the cavity defined by said hollow annular member includes a circumferentially extending portion receiving the circumferentially extending portion of the one housing.

5. Turbocharger as claimed in claim 4, wherein coolant inlet and outlet connections extend through the axially projecting portion of the one member to communicate coolant into and out of said cavity in the annular member.

6. Turbocharger as claimed in claim 4, wherein said hollow annular member includes a pair of circumferentially extending walls offset from each other to define said cavity in the hollow annular member between said offset walls, said walls terminating in a circumferential portion circumscribing said shaft.

7. Turbocharger as claimed in claim 4, wherein said hollow annular member includes a pair of axially spaced, circumferentially extending clamping surfaces, each of said center housing and said turbine housing including circumferentially extending surfaces for transmitting clamping forces to a corresponding clamping surface on said hollow annular member, said securing means including clamping means interconnecting the turbine housing and the center housing for causing the center housing and the turbine housing to generate axially directed forces against the clamping surface's of the hollow annular member.

8. Turbocharger as claimed in claim 7, wherein said clamping means is an axially extending bolt extending across said hollow annular member to interconnect the turbine housing with the center housing.

9. Turbocharger as claimed in claim 2, wherein said annular member includes a pair of axially spaced, circumferentially extending clamping surfaces, each of said center housing and said turbine housing including circumferentially extending surfaces for transmitting clamping forces to a corresponding clamping surface on said hollow annular member, and clamping means interconnecting the turbine housing and the center housing for causing the center housing and the turbine housing to generate axially directed, forces against the clamping surfaces of the hollow annular member.

10. Turbocharger as claimed in claim 9, wherein said hollow annular member includes a pair of circumferentially extending walls offset from each other to define said cavity in the hollow annular member between said offset walls, said walls terminating in a circumferential portion circumscribing said shaft.

* * * * *